US008137483B2

(12) United States Patent
Fedchun et al.

(10) Patent No.: US 8,137,483 B2
(45) Date of Patent: Mar. 20, 2012

(54) METHOD OF MAKING A LOW COST, HIGH STRENGTH, HIGH TOUGHNESS, MARTENSITIC STEEL

(76) Inventors: Vladimir A. Fedchun, Farmington Hills, MI (US); Gregory Vartanov, Oakville (CA)

( * ) Notice: Subject to any disclaimer, the term of this patent is extended or adjusted under 35 U.S.C. 154(b) by 365 days.

(21) Appl. No.: 12/387,893

(22) Filed: May 11, 2009

(65) Prior Publication Data

US 2009/0291013 A1 Nov. 26, 2009

Related U.S. Application Data

(60) Provisional application No. 61/128,189, filed on May 20, 2008.

(51) Int. Cl.
*C21D 1/22* (2006.01)
*C21D 8/00* (2006.01)

(52) U.S. Cl. ..... 148/505; 148/503; 148/506; 148/507; 148/578; 148/663; 148/653; 148/654; 148/504

(58) Field of Classification Search ..... 148/500–507, 148/332–336, 578, 653, 654, 663; 420/89–93, 420/108–111
See application file for complete search history.

(56) References Cited

U.S. PATENT DOCUMENTS 3,070,438 A * 12/1962 Kenneford ..... 148/332
4,650,645 A * 3/1987 Kato et al. ..... 420/111
4,895,700 A * 1/1990 Davison et al. ..... 420/8
7,067,019 B1 * 6/2006 Fedchun et al. ..... 148/333

FOREIGN PATENT DOCUMENTS

EP 0841410 A1 * 5/1998
EP 0928835 A1 * 7/1999

* cited by examiner

*Primary Examiner* — Deborah Yee
(74) *Attorney, Agent, or Firm* — Rader, Fishman & Grauer, PLLC

(57) ABSTRACT

A method of designing low cost, high strength, high toughness martensitic steel uses mathematical modeling to define optimum low cost chemical compositions, the content of retained austenite, and critical temperatures; melting an ingot, processing same, making steel articles, and heat treating the articles using the critical temperatures and the content of retained austenite. The new steel comprises, by weight, about 0.3-0.45% of C; at most 2.5% of Cr; at most 1.0% of Mo; at most 3.50% of Ni; about 0.3 to 1.5% of Mn; about 0.1-1.3% of Si; about 0.1-1.0% of Cu; Cu being less than Si; about 0.1 to 1.0% of V+Ti+Nb; at most 0.25% of Al; the sum of alloying elements being less than about 11.5%; the balance being essentially Fe and incidental impurities. Procedures of melting, processing and heat treatment using the mathematical model are disclosed.

3 Claims, 10 Drawing Sheets

TABLE VIII

CCT DIAGRAM OF STEEL A WITH OPTIMUM ALLOYING CONCENTRATION #1

TABLE I

INDUSTRIAL HIGH STRENGTH STEELS

| Type of Steel/ Alloying Element, % wt. | AerMet 100 | Marage 250 | AISI 4340 | 300M | AISI 8640 |
|---|---|---|---|---|---|
| C | 0.23 | 0.01 | 0.38- 0.43 | 0.38 – 0.46 | 0.38 - 043 |
| Ni | 11.10 | 18.5 | 1.65 – 2.0 | 1.65 – 2.0 | 0.55 |
| Co | 13.40 | 7.5 | - | - | - |
| Mo | 1.20 | 4.8 | 0.2 – 0.3 | 0.3 – 0.65 | 0.2 |
| Cr | 3.10 | - | 0.7 – 0.9 | 0.7 – 0.95 | 0.5 |
| Si | - | 0.1 | 0.15 – 0.3 | 1.45 – 1.8 | 0.23 |
| Mn | - | 0.1 | 0.6 - 0.8 | 0.6 – 0.9 | 0.88 |
| V | - | - | - | 0.05 | - |
| Cu | - | - | - | 0.11 | - |
| Fe | remainder | remainder | remainder | remainder | remainder |

FIG.1

TABLE II

MECHANICAL PERFORMANCE at ROOM TEMPERATURE

Of INDUSTRIAL HIGH STRENGTH STEELS

| Type/ Mechanical Performance | AerMet 100 900°F Aged | Marage 250 | AISI 4340 | 300M | AISI 8640 |
|---|---|---|---|---|---|
| Ultimate Tensile Strength (ksi) | 287 | 259 | 269 | 287 | 300 |
| Yield Strength (ksi) | 246 | 250 | 225 | 243 | 240 |
| Fracture Toughness K1c (ksi x √in) | 120 | 91.5 | 70 | 50 | - |
| Charpy V-notch Impact Energy (ft-lb) | 35 | 20.5 | 18 | 18 | 5.16 |

FIG. 2

TABLE III

COMPOSITION of NEW STEEL

| Alloying Element | Steel A % weight | Steel B % weight | Steel C % weight |
|---|---|---|---|
| C | 0.3 to 0.45 | 0.3 to 0.45 | 0.3 to 0.45 |
| Cr | at most 2.5 | at most 2.5 | at most 2.5 |
| Mo | at most 1.0 | - | - |
| Ni | at most 3.5 | at most 1.0 | - |
| Mn | 0.3 to 1.0 | 0.3 to 1.5 | 0.3 to 3.5 |
| Si | 0.1 to 1.3 | 0.1 to 1.3 | 0.1 to 1.3 |
| Cu | 0.1 to 1.0 less than Si | 0.1 to 1.0 less than Si | 0.1 to 1.0 less than Si |
| (V+Ti+Nb) | 0.1 to 1.0 | 0.1 to 1.0 | 0.1 to 1.0 |
| Al | at most 0.25 | at most 0.25 | at most 0.25 |
| Sum of Alloying Elements | less than 11.5 | less than 7.0 | less than 6.0 |
| Fe | remainder | remainder | remainder |

FIG.3

TABLE IV

MECHANICAL PROPERTIES OF NEW STEEL

AT ROOM TEMPERATURE

| Mechanical Properties | Steel A | Steel B | Steel C |
|---|---|---|---|
| Rockwell Hardness Scale C | 50- 54 | 51 - 54 | 52 - 55 |
| Ultimate Tensile Strength (ksi) | 265 - 295 | 27 - 310 | 280 - 310 |
| Yield Strength (ksi) | 220 - 245 | 220 - 260 | 220 - 245 |
| Charpy V-notch Impact Energy (ft-lb) | 26 - 36 | 18 - 32 | 18 - 27 |
| Fracture Toughness K1c (ksi x √in) | 80 - 110 | 60 - 100 | 60 - 70 |

FIG. 4

TABLE V

COST of CHARGED MATERIALS of

INDUSTRIAL HIGH STRENGTH STEELS and

NEW STEEL

| Type of Steel | Cost of Charged Materials USD / Mt<br>London Metal Exchange, October 2008 |
|---|---|
| Steel A | $2,800 |
| AerMet 100 | $18,020 |
| Marage 250 | $16,650 |
| | |
| Steel B | $1,210 |
| 300M | $1,760 |
| AISI 4340 | $1,470 |
| | |
| Steel C | $960 |
| AISI 8640 | $1,850 |

FIG. 5

TABLE VI
MICROSTRUCTURE of STEEL B

FIG. 6 (x 5000)

TABLE VIII
CCT DIAGRAM OF STEEL A WITH OPTIMUM ALLOYING CONCENTRATION #1
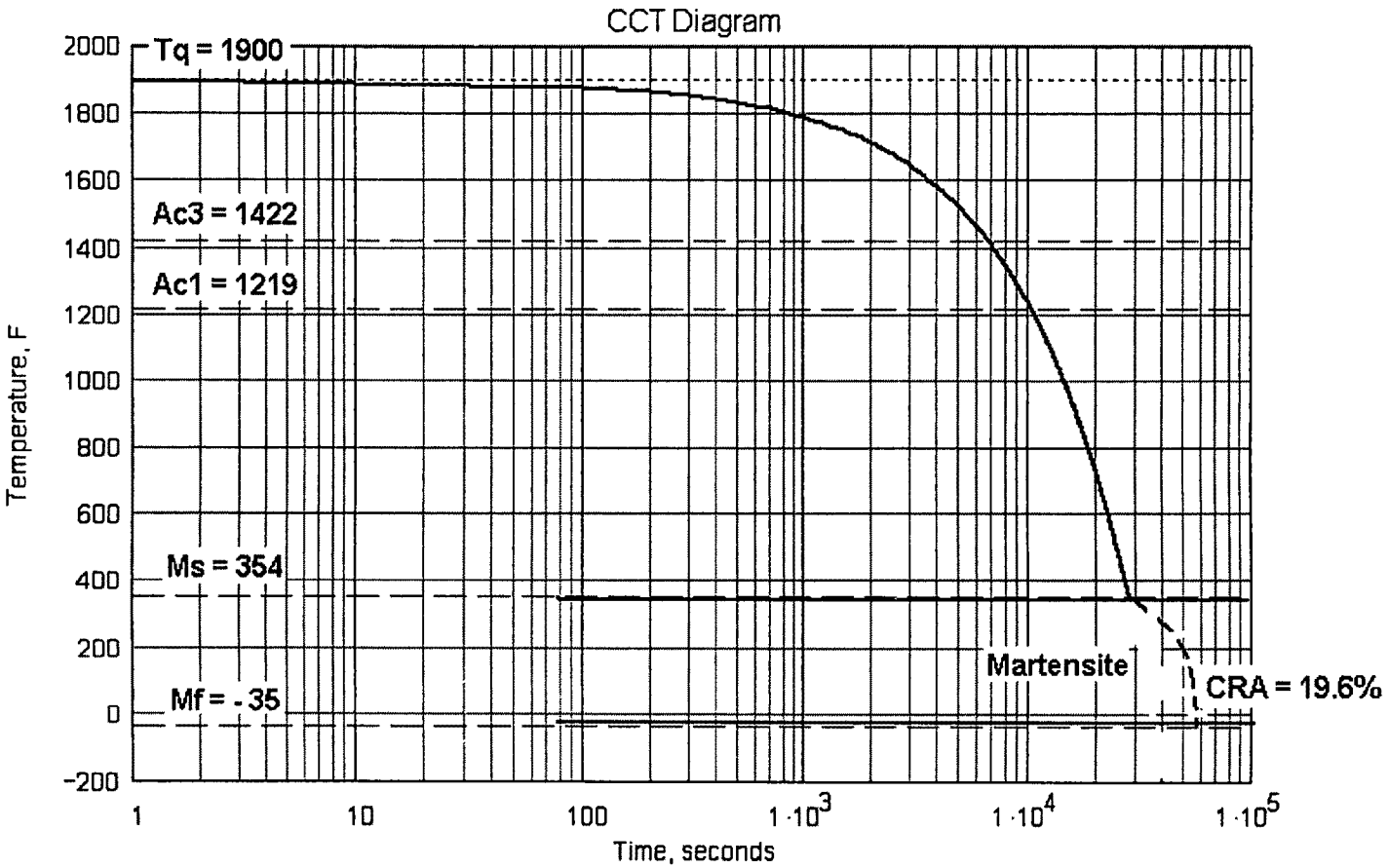
FIG. 8.1

TABLE VIII
CCT DIAGRAM OF STEEL B WITH THE OPTIMUM ALLOYING CONCENTRATION #2
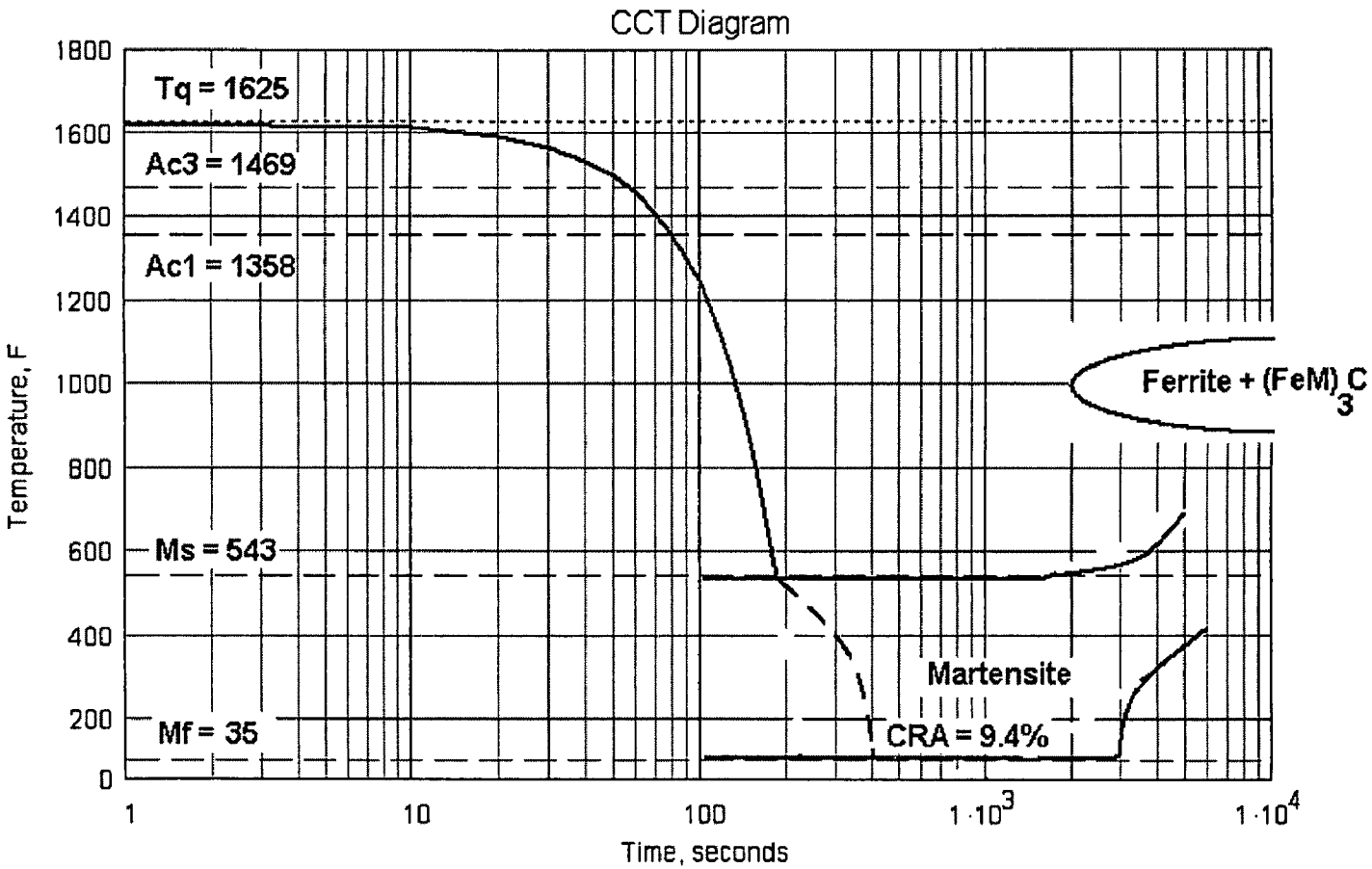
FIG. 8.2

TABLE VIII
CCT DIAGRAM OF STEEL C WITH THE OPTIMUM ALLOYING CONCENTRATION #3
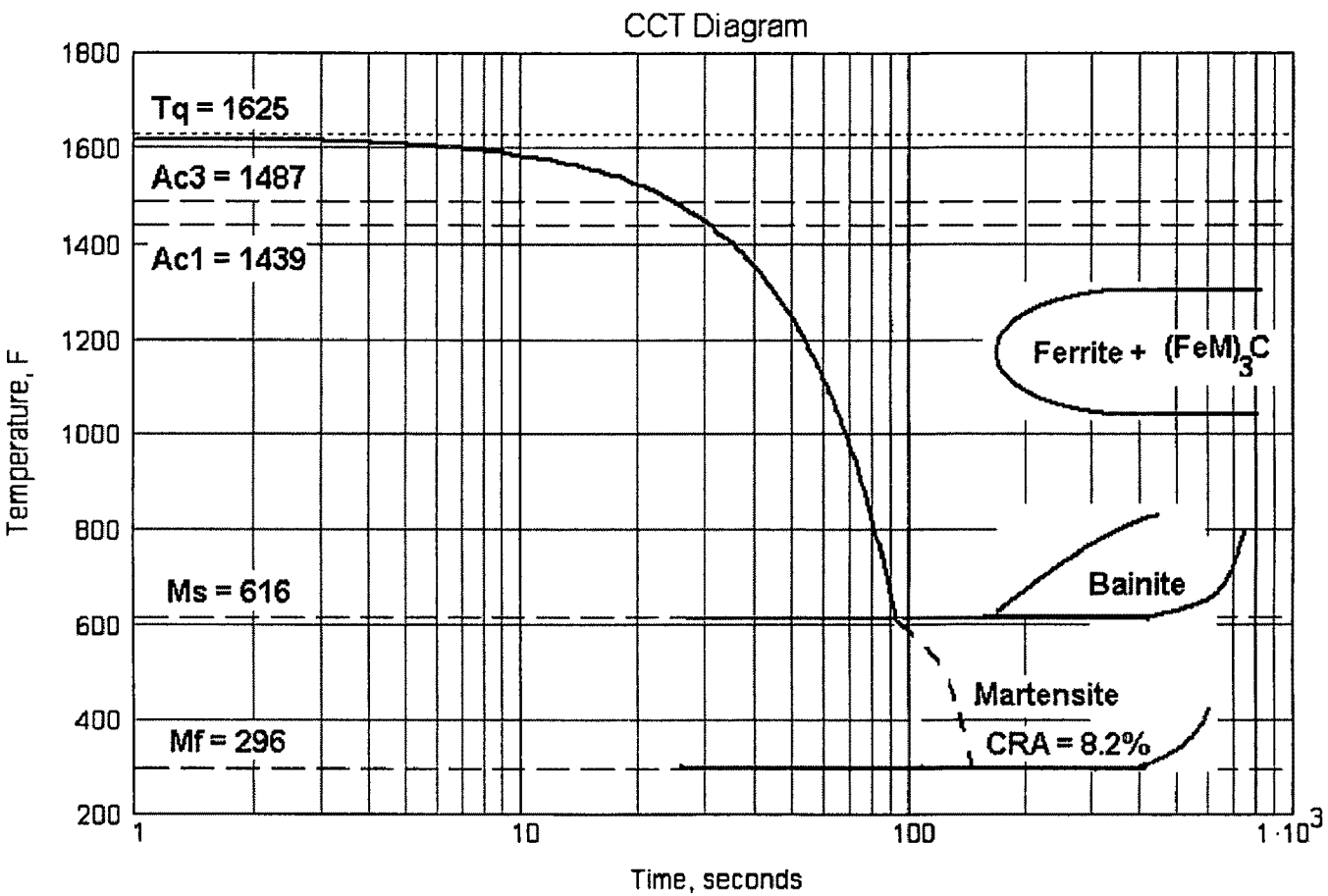
FIG. 8.3

METHOD OF MAKING A LOW COST, HIGH STRENGTH, HIGH TOUGHNESS, MARTENSITIC STEEL

RELATED APPLICATIONS

This application claims the benefit of priority of U.S. provisional patent application No. 61/128,189, filed May 20, 2008, which is hereby incorporated by reference in its entirety.

FIELD OF THE INVENTION

This invention relates to a method of reducing the cost of a high strength steel, and more particularly to a method which uses a mathematical model to define a martensitic steel composition that has the strength and toughness properties of a higher cost high strength, high toughness steel.

BACKGROUND OF THE INVENTION

Current high stressed aircraft/aerospace, military, automotive, and oil/gas members are made of expensive high strength, high toughness steels. They have an ultimate tensile strength of about 250 to 300 ksi, a yield strength of about 200 to 250 ksi, a an Charpy v-notch impact toughness energy of about 18 to 36 ft-lbs, and a fracture toughness ($K_{Ic}$) of about 50 to 110 ksi√in. As used herein a high-strength, high toughness steel has or exceeds these physical properties.

AerMet 100 and Marage 250 are examples of high cost high strength, high toughness alloy steels that are used in aircraft/aerospace. AerMet 100, the most costly, has by weight 13.4% of cobalt (Co), 1.2% of molybdenum (Mo), and 11.1% of nickel (Ni). Its high cost is due to large amounts of expensive alloying elements and high energy consuming processes, such as vacuum arc remelting (VAR) and electroslag remelting (ESR).

300M and AISI 4340 steels are examples of high strength, moderate impact toughness steels that are used for aircraft/aerospace members. They have by weight 1.65 to 2.0% of Ni and 0.2 to 0.65% of Mo.

U.S. Pat. No. 7,067,019 is an example of a high strength steel without Co and Mo and with content of Ni varying from about 1.0 to about 8.0%. Its cost is comparable to high strength steels, such as 300M, and 4340, but its toughness is higher.

U.S. Pat. No. 6,426,038 is an example of a low cost, high strength, moderate toughness steel in which the elements cobalt, molybdenum, and nickel are eliminated.

SUMMARY OF THE INVENTION

The present invention is directed to reducing the cost of high strength, high toughness martensitic steel and en articles made thereof utilizing a mathematical model for defining an optimum cost effective composition and provides required levels of high strength and high toughness for highly stressed aircraft/aerospace, military, automotive, and oil/gas members.

The new method is comprised of the following steps:

Applying a mathematical model to define an optimum low cost composition with a lath martensitic microstructure that provides specified levels of high strength and high toughness.

Using the model to predict the critical temperatures and the amount of retained austenite of the optimum low cost composition.

Melting the optimum chemical composition.

Processing ingots of the new steel using the predicted critical temperatures and the content of retained austenite.

Producing articles from the ingots of the new steel.

Heat treating treat the articles using the predicted critical temperatures and content of retained austenite.

Verifying the properties of the new steel by mechanical testing.

Three embodiments were established with the new method. The first embodiment (Steel A) is a low cost replacement for the AerMet 100 and Marage 250 steels. Steel A is cobalt-free for aircraft/aerospace and military applications that has less than 11.5% wt. of alloying elements. Steel A has mechanical properties that are close to those of the AerMet 100 and Marage 250, while its cost is substantially lower.

The second embodiment (Steel B) is a low cost replacement of AISI 4340 and 300M steels. Steel B is cobalt-molybdenum-free and has less than 1% wt. of nickel and less than 7% wt. of alloying elements. It is substantially lower in cost than either AISI 4340 or 300M steels.

The third embodiment (Steel C) is cobalt-molybdenum-nickel free and has less than 6% wt. of alloying elements.

The chemical composition of Steel A, B, and C are shown in FIG. 3 and their room temperature mechanical properties are shown in FIG. 4.

Steel A, B, and C differ from current high strength steels by one or more of the following features:

- The absence of Co in Steels A; B, and C; the absence of Mo in steel B and C; and the absence of Ni in Steel C.
- Steel A, B, and C have lath martensitic microstructures comprised of small packets of martensite laths grown on fine particles of carbides and retained austenite. The boundaries of the packets are free of carbides, and the content of retained austenite, $$CRA = \frac{\text{Value of Retained Austenite}}{\text{Total Value}} \times 100\%$$

is less than 25% for Steel A; less than 15% for Steel B; and less than 10% for the Steel C. The lath martensitic microstructures supply Steels A, B, and C with high strength and high toughness.

- The ultimate tensile strength of low cost Steel A is 275 to 295 ksi and its yield strength is 220 to 245. The ultimate tensile strength of low cost Steel B is 275 to 310 ksi and its yield strength is 220 to 260. The ultimate tensile strength of low cost Steel C is 280 to 310 ksi and its yield strength is 220 to 245.
- The Steel A Charpy V-notch impact toughness energy is 26 to 36 ft-lb and its fracture toughness (K1c) is 80 to 110 ksi√in. The Steel B Charpy V-notch impact toughness energy is 18 to 32 ft-lb and its fracture toughness is 60 to 100 ksi√in.
- The Steel C Charpy V-notch impact toughness energy is 18 to 27 ft-lb and its fracture toughness is 60 to 70 ksi√in.
- Steel A possesses unique physical properties. After a second hardening, its yield strength is increased to 260-280 ksi but its impact toughness energy is only decreased from 26-36 ft-lb to 16-20 ft-lb
- The ductility and formability of the Steel A and B are high during hot forging and rolling.
- Steels B and C use only homogenized and recrystallization annealing without normalizing and high tempering.
- Steel C is heat treated without refrigeration
- The high energy consumption processes of vacuum arc remelting (VAR) and/or electroslag remelting (ESR) are eliminated for refining Steels A, B, and C.

The open induction furnace is used for melting Steels A, B, and C rather than the vacuum induction and vacuum arc furnaces The continuous casting process is used for Steel C In employing the teachings of the present invention, a plurality of alternate compositions can be provided to achieve the desired results and capabilities. In this specification, only a single embodiment is presented for the purpose of disclosing the invention. However, this embodiment is intended as an example only and should not be considered as limiting the scope of the invention.

The foregoing features, benefits, objects and best mode of practicing the invention and additional benefits and objects will become apparent from the ensuing detailed description of a preferred embodiment and the subject matter in which exclusive property rights are claimed is set forth in the numbered claims which are appended to the detailed description of a preferred embodiment.

BRIEF DESCRIPTION OF THE DRAWINGS

FIG. 1 is a table showing the compositions of five industrial high strength steels in the prior art.

FIG. 2 is a table showing the performance of the five industrial high strength steels of FIG. 1.

FIG. 3 is a table showing chemical compositions of the low cost, high strength, high toughness martensitic steel according to the present invention.

FIG. 4 is a table showing the mechanical properties at room temperature of the new steel of FIG. 3.

FIG. 5 compares the costs of charged materials of the industrial steels of FIG. 1 and the new steel of FIG. 3.

FIGS. 8.1, 8.2, and 8.3 show Continuous Cooling Transformation (CCT) diagrams of the new steel that were defined by the results of the modeling.

Figure 6:
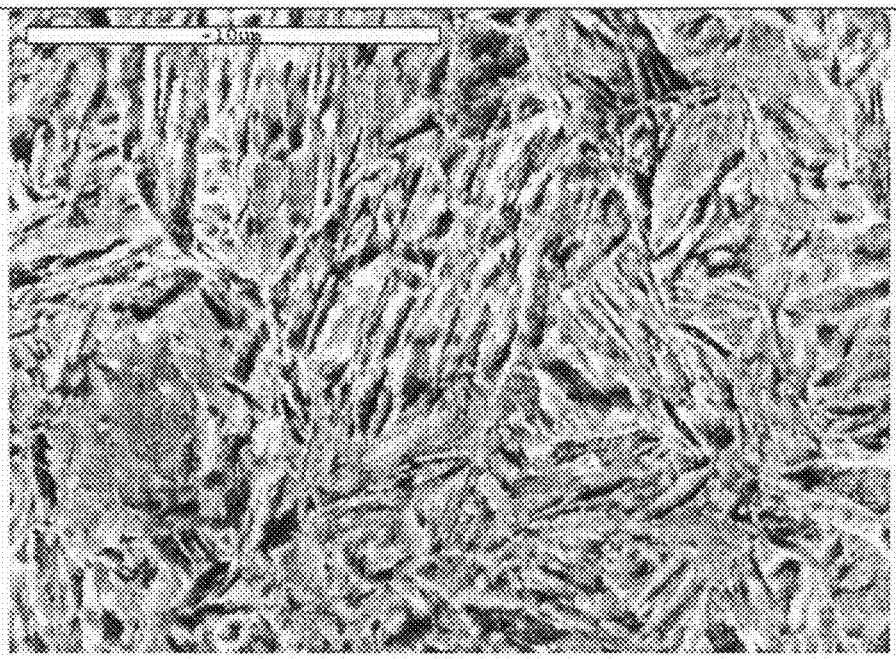
FIG. 6 shows the microstructures of the new steel of FIG. 3.

The mathematical model and examples of optimum compositions based on the model that were developed and tested are submitted below.

Mathematical Model of Mechanical Properties, Critical Temperature, Content of Retained Austenite, and Optimum Chemical Composition The strength and toughness of a martensitic steel are related to its microstructure. Therefore, a quantitative estimate of the microstructure is important for an understanding of a new high strength, high toughness martensitic steel. The microstructure of the new steel is composed of small packets of martensite laths grown on fine particles of carbides and retained austenite with boundaries of the packets free of carbides. The content of retained austenite is dependent on its alloying elements, processing, and heat treatment.

The mathematical model relates the mechanical properties of high strength, high toughness steels to quantitative estimates of microstructures, alloying concentrations and content of retained austenite. A martensitic transformation forms the martensitic microstructure and determines mechanical properties of the new steel. The new mathematical model is based on a concept that free energy and alloying concentrations in a system determine a martensitic transformation and as a consequence the mechanical properties of the steel.

The free energy is a sum of a chemical energy, $E_{ch}$, an interfacial energy, $E_{surf}$, and an elastic strain energy, $E_{str}$. The free energy of the martensite phase of the new steel is expressed by the following equation, $$E_{sys}=E_{ch}+E_{surf}+E_{surf} \quad (1)$$

Here, the chemical energy, $E_{ch}$ is set to be zero, because as a rule the austenite-martensite ($\gamma\rightarrow\alpha'$) transformation takes place without chemical reactions.

For steels with tempered martensitic microstructures and carbon concentrations up to 0.40% wt. the interfacial energy, Esurf is up to 0.4 J/mol (joule per mole) and the elastic strain energies, energies, Estr is more than 8 J/mol. So, the main driver force ($\gamma\rightarrow\alpha'$) of the transformation is the elastic strain energy, Estr.

The ultimate tensile strength, UTS, yield strength, YS, elongation, EL, reduction of area, RA, Charpy v-notch impact energy, CVN, critical temperatures, and content of retained austenite of the new steel are essentially dependent on concentrations of alloying elements, $C_i$, the elastic strain energy, $E_{str}$, and the interfacial energies, $E_{surf}$. At the same time, the elastic strain energy, $E_{str}$ and the interfacial energies, $E_{surf}$ depend on the concentrations of alloying elements, $C_i$ and other not essential for the present invention parameters $X_1, \ldots, X_n$.

$$E_{str}=F_{str}(C_i,X_1,\ldots,X_n),\ E_{surf}=F_{surf}(C_i,X_1,\ldots,X_n) \quad (2)$$

$$\mathrm{UTS}(C_i,F_{str},F_{surf})=F^{(1)}(C_i),\mathrm{YS}(C_i,F_{str},F_{surf})=F^{(2)}(C_i), \quad (3)$$

$$\mathrm{RA}(C_i,F_{str},F_{surf})=F^{(3)}(C_i),\mathrm{EL}(C_i,F_{str},F_{surf})=F^{(4)}(C_i) \quad (4)$$

$$\mathrm{CVN}(C_i,F_{str},F_{surf})=F^{(5)}(C_i) \quad (5)$$

where, $F^{(1)}(C_i)$, $F^{(2)}(C_i)$, $F^{(3)}(C_i)$, $F^{(4)}(C_i)$, and $F^{(5)}(C_i)$ are the differentiable functions of alloying concentrations $C_i$, i=(1 . . . n), n is the number of alloying elements of the new steel.

Upper and low critical temperatures, $A_{c3}$ and $A_{c1}$, martensitic start temperature, $M_s$ are of vital importance for the processing and heat treatment of the new martensitic steel. The below described mathematical model of the prediction of the $A_{c3}$, $A_{c1}$, and $M_s$ is based on a concept that the chemical composition of the new steel is the main factor affected by the critical and martensitic start temperatures, so:

$$A_{c3}=F^{(6)}(C_i);\ A_{c1}=F^{(7)}(C_i);\ M_s=F^{(8)}(C_i) \quad (6)$$

The mechanical properties of the new steel are affected by the content of retained austenite which is dependent on heat treatment, essentially refrigeration and alloying concentrations. The model is based on a concept that the heat treatment and alloy concentrations of the new steel are the main factors affected by the content of retained austenite:

$$\mathrm{CRA}=R(T,t)\cdot F^{(9)}(C_i) \quad (7)$$

where, $F^{(9)}(C_i)$ is the differentiable function of variable alloying concentrations, R(T,t) is a function of heat treatment, and is dependent on temperature, T and time of heat treatment, t; this function is connected with the CCT diagram of the new steel.

Test results depend on heat treatment, so the modeling is valid for only an established heat treatment. Comparisons of the results of modeling with experimental data of different heat treatments are not correct.

The new steel was melted and tested with different n alloying concentrations $C_{mi}$, where, m is a numerical number of melting and testing (m=1 . . . n+1) and i is a numerical number of alloying elements (i=1 . . . n), n+1 is a total number of melting and testing.

Choose one steel and designate its alloy concentrations and test results by the numeral 1.

The liner expansions of the functions $F^{(k)}(C_i)$ (k=1 . . . 9) of the Taylor's series near alloying concentration $C_{11}$ are expressed by the following equations:

$$F^{(k)}(C_i) = F_1^{(k)} + \sum_{i=1}^{n} \frac{\partial F^{(k)}(C_{1i})}{\partial C_i} \times (C_i - C_{1i}) + g^{(k)}(C_i - C_{1i}) \quad (8)$$

$$(k = 1 \ldots 5)$$

where:

$F_1^{(k)}=F^{(k)}(C_{1i})$ are the functions of the concentrations $C_{1i}$ (i=1 . . . n);

$g^{(k)}(C_i-C_{1i})$ (k=1 . . . 9) are error functions that determine errors in the linear approximation.

The errors of the linear approximation are expressed by the equations, $$g^{(k)}(C_i - C_{1i}) \le h^{(k)} \times \sum_{i=1}^{n} (C_i - C_{1i})^2 (k = 1 \ldots 5), \quad (9)$$

$$\text{where, } h^{(k)} = \max\left(\sum_{i,j=1}^{n} \frac{\partial^2 F^{(k)}(C_{1i})}{\partial C_j \partial C_i}\right).$$

To define $F^{(k)}(C_i)$ for variable alloying concentrations $C_i$ close to the concentration $C_{1i}$, the functions $$\frac{\partial F^{(k)}(C_{1i})}{\partial C_i}$$

should be determined.

The below described method utilizes experimental data for determining the functions, $$\frac{\partial F^{(k)}(C_{1i})}{\partial C_i} (k = 1 \ldots 9).$$

After disregarding the error of the linear approximation $g^{(k)}(C_i-C_{1i})$, the results of the n+1 melting and testing are expressed by the following system of linear equations, $$\Delta F_m^{(k)} = \sum_{i=1}^{n} \frac{\partial F^{(k)}(C_{1i})}{\partial C_i} \times (C_{mi} - C_{1i}), \quad (10)$$

$$(m = 2 \ldots n + 1)(k = 1 \ldots 9)$$

where, $$\Delta F_m^{(k)} = F_m^{(k)}(C_{mi}) - F_m^{(k)}(C_{1i}).$$

The k systems of nine linear equations (10) can be written in the matrix form, $$(\Delta F^{(k)}) = C \cdot (A^{(k)}), \quad (11)$$

where the vector $(\Delta F^{(k)})$ has components equal to $(F_m^{(k)}(C_{mi})-F_m^{(k)}(C_{1i}))$, the vector $(A^{(k)})$ has components equal to $$\left(\frac{\partial F^{(k)}(C_{1i})}{\partial C_i}\right),$$

and the matrix C has components equal to $(C_{mi}-C_{1i})$ (m=2 . . . n+1; i=1 . . . n). The equation (11) has a unique solution if det(C)≠0, where, det(C) is the determinant of the matrix C. The exact solution of the equation (8) is expressed by the relation, $$(A^{(k)}) = C^{-1} \cdot (\Delta F^{(k)}) \ (k=1 \ldots 9) \quad (12)$$

where, $C^{-1}$ is the inverse matrix of the matrix C.

There are other ways of solving the system (11), such as Cramer's rule, the Gauss elimination method, the LU decomposition, and other methods. Matrix equations (9) define nine vectors $(A^{(k)})$ that determine the partial derivatives of the functions $F^{(k)}$ $$\left(\frac{\partial F^{(k)}(C_{0i})}{\partial C_i}\right) \text{ at } C_i = C_{0i}.$$

The determined components $$\left(\frac{\partial F^{(k)}(C_{1i})}{\partial C_i}\right)$$

allow us to define the functions $F^{(k)}(C_i)$ for variable alloy concentrations $C_i$ (i=1 . . . n) that differ from $C_{mi}$ and $C_{1i}$ by the equations (5). The known functions $F^{(k)}(C_i)$ define UTS, YS, EL, RA, CVN, $A_{c3}$, $A_{c1}$, $M_s$, and CRA.

The model allows us to predict the functions $F^{(k)}(C_i)$ near $C_{1i}$ by the results of n+1 melting and testing.

The alloy concentrations $C_{2i}$ are closest to $C_{1i}$ if $$\sqrt{\sum_{i=1}^{n} (C_{mi} - C_{1i})^2}$$

(m=2 . . . n+1; i=1 . . . n) and has a minimum value for $C_{2i}$.

This is the first step of the modeling.

In the second step, the alloy concentrations $C_{1i}$ are eliminated from the experimental data, and one extra result of melting and testing with alloying concentrations $C_{adi}$ is added to the database. The functions $F^{(k)}(C_i)^{(2)}$ (the upper index indicates the second step) are defined near the alloy concentrations $C_{2i}$ and the second step with the new database repeats the first step.

On the third step, the alloy concentrations $C_{2i}$ are eliminated and the functions $F^{(k)}(C_i)^{(3)}$ are defined near the alloy concentrations $C_{3i}$ that are closest to $C_{2i}$ and the third step with the new database repeats the second step.

In the s-th step, the alloy concentrations of the (s−1)-th step are eliminated and the functions $F^{(k)}(C_i)^{(s)}$ are defined near $C_{si}$ that is the closest to $C_{s-1i}$ and the s-th step with the new database repeats the (s−1)-th step.

As a result of the above described stepping method, a link of nodes of the alloy concentrations $C_{1i}, C_{2i}, \ldots, C_{si}$ and the functions $F^{(k)}(C_{1i})^{(1)}$, $F^{(k)}(C_{2i})^{(2)}$, . . . , $F^{(k)}(C_{si})^{(s)}$ are obtained. For the s-th step, the first s−1 alloy concentrations are eliminated and extra s−1 alloy concentrations are added. To perform the modeling with s steps, (n+s) melting and testing should be conducted.

For an alloying concentration with one alloying element n=1, the method automatically transfers to the well known linear spline interpolation method on the XY plane.

So, the above described model is an extension of the liner spline interpolation method of the XY plane to the linear spline interpolation method of the n+1 dimensional space.

The chemical composition is named an optimum chemical composition if it satisfies the following conditions:

The optimum chemical composition $C^*_i$ provides the lowest cost of the new steel The mechanical properties satisfy the following conditions UTS≧UTS*, YS≧YS*, RA≧RA*, EL≧EL*, and CVN≧CVN* where, UTS*, YS*, RA*, EL*, and CVN* are the targeted mechanical properties The mathematical problem is formulated in the following manner. Define the optimum alloying concentration $C_i^*$ that supplies the lowest value of $$\sum_{i=1}^{n}(Y_i \times C_i) \tag{13}$$

and the following constraints $$F_0^{(k)} + \sum_{i=1}^{n} \frac{\partial F^{(k)}(C_{0i})}{\partial C_i} \times (C_i - C_{0i}) \geq F^{*(k)} (k = 1 \ldots 5), \tag{14}$$

where, $Y_i$ is cost of the alloying element with number i, $C_{0i}$ is the known concentrations, and $F_0^{(k)}$ are the known functions, $F^{*(k)}$ are the targeted constants.

Well-known linear programming (LP) is a technique for optimization of a linear function subjected to linear inequality constraints. The linear cost function (13) and the linear inequalities (14) are the classical converted LP problem.

To find the optimum alloying concentration, $C_i^*$ of the cost function (13) and the linear inequalities (14), usually the Linear Programming (LP) technique is utilized.

The well-known simplex algorithm is utilized to solve the LP problem.

CONCLUSIONS

The new mathematical model defines the optimum alloying concentration, mechanical properties, the critical temperatures, and the content of retained austenite (CRA) of the new steel by utilizing experimental data Defining the mechanical properties, the critical temperatures, and a content of retained austenite of the new steel with n alloying elements by utilizing only n+1 results of melting and testing is an advantage of the new model; non-linear approximations demand significantly more melting and testing; for example, for a quadratic approximation it is necessary to have results of $n^2$ melting and testing.

The new model allows us to find the optimum chemical composition of the new steel The new model is an extension of the well-known linear spline interpolation method of the two dimensional space to the linear spline interpolation of n+1 dimensional space.

Calculation of Optimum Alloying Concentration, Mechanical Properties, Critical Temperatures, and Content of Retained Austenite of Steel B and Steel C The chemical composition of the new molybdenum-free steel comprises C (carbon), Cr (chromium), Ni (nickel), Mn (manganese), Cu (copper), V (vanadium), and Si (silicon). To predict an optimum alloying concentration that supplies a low cost of charged materials and targeted mechanical properties, a modeling of the new steel with constant concentrations of Mn of about 0.8% wt., Cu of about 0.55% wt., V of about 0.25% wt., and Si of about 0.9% wt., and variable concentrations of C of 0.35 to 0.45% wt., Cr of 1.0 to 2.0% wt., and Ni of 0 to 1.0% wt. was performed.

After calculation the UTS, YS, EL, RA, CVN, $A_{c3}$, $A_{c1}$, $M_s$, and CRA according to the model (5)-(9), the following results were obtained:

$$UTS=290\cdot(1+0.913\cdot(C-0.4)+0.040\cdot(Cr-1.48)-0.002\cdot(Ni-0.32))\ (ksi) \tag{15}$$

$$YS=240\cdot(1+1.257\cdot(C-0.4)+0.069\cdot(Cr-1.48)-0.027\cdot(Ni-0.32))\ (ksi) \tag{16}$$

$$EL=10.5\cdot(1-1.527\cdot(C-0.4)-0.087\cdot(Cr-1.48)+0.068\cdot(Ni-0.32))(\%) \tag{17}$$

$$RA=44\cdot(1-3.358\cdot(C-0.4)-0.043\cdot(Cr-1.48)+0.027\cdot(Ni-0.32))(\%) \tag{18}$$

$$CVN=20\cdot(1-3.850\cdot(C-0.4)-0.032\cdot(Cr-1.48)+0.243\cdot(Ni-0.32))\ (ft\text{-}lb) \tag{19}$$

$$A_{C3}=1500\cdot(1-0.011\cdot(C-0.46)+0.018\cdot(Cr-1.89)-0.011\cdot Ni)\ (F) \tag{20}$$

$$A_{C1}=1436\cdot(1-0.112\cdot(C-0.46)+0.019\cdot(Cr-1.89)-0.053\cdot Ni)\ (F) \tag{21}$$

$$M_S=536\cdot(1-1.140\cdot(C-0.46)-0.046\cdot(Cr-1.89)-0.117\cdot Ni)\ (F) \tag{22}$$

$$CRA=8.5\cdot(1+0.796\cdot(C-0.46)-0.104\cdot(Cr-1.89)+0.12\cdot Ni)(\%) \tag{23}$$

The equations (15)-(23) define the mechanical properties, critical temperatures, and content of retained austenite of the new steel as functions of the C, Cr, Ni concentrations and Mn of 0.8, Cu of 0.55, V of 0.25, and Si of 0.9% wt. The equations are based on the experimental data of the new steel subjected to refrigeration.

Optimum alloying concentration was defined by utilizing the targets of mechanical properties UTS*=275 (ksi), YS*=220 (ksi),
CVN*=22 (ft-lb) by utilizing the liner cost function (13) and liner constraints (14). The costs of the charged materials are based on data of the London Metal Exchange (LME), dated October, 2008.

The optimum alloying concentration of the new steel was found for:

Minimum of the liner cost function (cost of charged materials of the new steel) (Y1·C+Y2·Cr+Y3·Ni), where Y1=800 $/Mt (US dollar per metric ton)). Y2=4,100, Y3=11,500 are the cost of charged materials that are based on data of the London Metal Exchange (LME), dated October, 2008.

UTS, YS, and CVN satisfied the following constraints $$290\cdot(1+0.913\cdot(C-0.4)+0.040\cdot(Cr-1.48)-0.002\cdot(Ni-0.32))\geqq 275 \quad (24)$$

$$240\cdot(1+1.257\cdot(C-0.4)+0.069\cdot(Cr-1.48)-0.027\cdot(Ni-0.32))\geqq 220 \quad (25)$$

$$20\cdot(1-3.850\cdot(C-0.4)-0.032\cdot(Cr-1.48)+0.243\cdot(Ni-0.32))\geqq 22 \quad (26)$$

The constraints of the alloying concentrations were $0.35\leqq C\leqq 0.45$, $1.0\leqq Cr\leqq 2.0$, $0\leqq Ni\leqq 1.0$ (%, wt.); other concentrations Mn=0.7, Cu=0.55, V=0.25, Si=0.9 were kept as constants.

The optimum alloying concentrations were found by the well known simplex method. The following results of the optimum alloying concentrations were obtained:

C=0.35, Cr=1.358, and Ni=0

Further, these optimum alloying concentrations will be marked as #3.

The mechanical properties, critical temperatures, and a content of retained austenite of the optimum alloying concentrations #3 equal to:

UTS=275.5 (ksi), YS=224.9 (ksi), EL=11.185(%), RA=47.734(%), and CVN=22.4 (ft-lb); $A_{C3}$=1487, $A_{C1}$=1439, and $M_s$=616.331 (F); CRA=8.2(%).

Further, the properties of the optimum alloying concentrations #3 will be marked as the properties #3.

FIG. 8.3 shows a Continuous Cooling Transformation (CCT) diagram of Steel C.

Based on the optimum alloying concentration #3, melting, processing, and heat treatment were conducted, and mechanical properties of Steel C are submitted in Example 3.

The optimum chemical composition of the targeted mechanical properties UTS*=275 (ksi), YS*=220 (ksi), CVN*=25 (ft-lb) was found by utilizing the above described method. The constraints of the alloying concentrations were $0.35\leqq C\leqq 0.45$, $1.0\leqq Cr\leqq 2.0$, $0\leqq Ni\leqq 1.0$ (%, wt.); other concentrations Mn=0.7, Cu=0.55, V=0.25, Si=0.9 were kept as constants The optimum alloying concentration were obtained using the same method as for the optimum alloying concentration #3:

C=0.37, Cr=1.289, and Ni=1.0

Further, this optimum alloying concentration will be marked as #2.

The mechanical properties, critical temperatures, and content of retained austenite of the new steel of the optimum alloying concentration #2 equal to:

UTS=279.4 (ksi), YS=223.4 (ksi), EL=11.88(%), RA=49.81 (%), and CVN=25.7 (ft-lb); $A_{C3}$=1469, $A_{C1}$=1358, and $M_S$=543 (F); CRA=9.44(%).

Further, the properties of optimum alloying concentrations #2 will be marked as properties #2.

FIG. 8.2 shows a Continuous Cooling Transformation (CCT) diagram of Steel B.

Based on the optimum alloying concentration #2 and the above submitted calculation, melting, processing, and heat treatment were conducted, and mechanical properties of Steel B are submitted in Example 2.

For defining the optimum alloying concentrations #2 and #3, only one step was utilized, because the intervals of change of C, Cr, and Ni were narrow. Otherwise, a several steps are necessary.

Chemical Composition and Mechanical Properties of Steel A

One way to improve the strength of martensitic steels is by a second hardening.

The second hardening process consists of heating at 750 to 950 F for 3-7 hours to precipitate fine vanadium carbide, VC, and it allows an increase in yield strength of martensitic steel from 220-245 ksi after low tempering at 350-400 F for 3-3.5 hours to 260-280 ksi after low tempering at 350-400 F for 3-3.5 hours plus middle tempering at 750-950 F for 5 hours.

The main disadvantage of second hardening is a dramatic falling of impact toughness, because the temperature interval of second hardening coincides with a temperature interval of a reversible embrittlement (reversible temper brittleness) of martensitic steels.

The below submitted model describes Steel A that possesses unique mechanical properties. After the second hardening, its yield strength increases to 260-280 ksi but its impact toughness energy decreases from 26-36 ft-lb to 16-20 ft-lb.

This result of Steel A was obtained by:

Special concentrations of Ti up to 0.15% wt. and V up to 0.5% wt.

Addition of Mo up to 1% wt.

Concentration of Ni up to 4.5% wt.

Austenizing at 1875-1900 F for 1 hour during quenching

Conducting a low tempering at 350-400 F for 3-3.5 hours and after that a middle tempering at 750-950 F for 5 hours.

A calculation of properties of Steel A is submitted below.

Calculation of the Mechanical Properties, Critical Temperatures, and Content of Retained Austenite of Steel A The chemical composition of the Steel A comprises: C (carbon), Cr (chromium), Mo (molybdenum), Mn (manganese), Cu (copper), V (vanadium), Ti (titanium) and Si (silicon). To define an optimum alloying concentration that supplies low cost of charged materials and targeted mechanical properties, a model of Steel A with constant concentrations of Mn of about 0.8% wt., Cu of about 0.55% wt., V of about 0.25% wt., Ti of about 0.12% wt., and Si of about 0.9% wt., and variable concentrations of C of 0.35 to 0.45% wt., Cr of 1.0 to 2.0% wt., Ni of 2.0 to 4.5% wt., and Mo of up to 1.0% wt. was created.

Based on the new model, after quenching, refrigeration, and low tempering, UTS (ksi), YS (ksi), and CVN (ft-lb) of Steel A, are expressed by the following equations:

$$UTS=269.0\cdot(1+0.570\cdot(C-0.35)+0.008\cdot(Cr-1.28)-0.024\cdot(Ni-4.0)+0.15\cdot Mo) \quad (27)$$

$$YS=221\cdot(1+0.469\cdot(C-0.35)+0.009\cdot(Cr-1.28)-0.015\cdot(Ni-4.0)+0.015\cdot Mo) \quad (28)$$

$$CVN=33\cdot(1-2.077\cdot(C-0.35)-0.020\cdot(Cr-1.28)+0.062\cdot(Ni-4.0)\cdot 0.029\cdot Mo) \quad (30)$$

Based on the new model, after quenching, refrigeration, low tempering and after that middle tempering, UTS, YS, and CVN of Steel A are expressed by the following equations:

$$UTS=293\cdot(1+0.683\cdot(C-0.35)+0.012\cdot(Cr-1.28)-0.024\cdot(Ni-4.0)+0.023\cdot Mo) \quad (31)$$

$$YS=240\cdot(1+0.687\cdot(C-0.35)+0.013\cdot(Cr-1.28)-0.015\cdot(Ni-4.0)+0.024\cdot Mo) \quad (32)$$

$$CVN=21.5\cdot(1-2.074\cdot(C-0.35)-0.02\cdot(Cr-1.28)+0.062\cdot(Ni-4.0)-0.031\cdot Mo) \quad (33)$$

Optimum chemical composition of Steel A was found for the following constraints $0.35\leqq C\leqq 0.45$, $1.0\leqq Cr\leqq 2.0$, $1.0\leqq Ni\leqq 3.5$ (%, wt.), other concentrations were Mn=0.7, Cu=0.55, V=0.25, Si=0.9, Mo=0.5, and Ti=0.12. The following mechanical properties were defined as targeted UTS*=275 (ksi), YS*=225 (ksi), CVN*=29 (ft-lb). The cost function equals to (Y1·C+Y2·Cr+Y3·Ni), where Y1=800 $/Mt (US dollar per metric ton), Y2=4,100, Y3=11,500 are the costs of the charged materials that are based on data of the London Metal Exchange (LME), dated October, 2008.

The optimum alloy concentrations of Steel. A subjected to quenching, refrigerating, and low tempering equals to
C=0.40, Cr=1.225, and Ni=3.5
Further, this optimum alloying concentration will be marked as #1.

C=0.40, Cr=1.225, Ni=3.5, Mn=0.7, Cu=0.55, V=0.25, Si=0.9, Mo=0.5, and Ti=0.12

The mechanical properties of Steel A with the optimum alloying concentration #1 equal to:

After quenching, refrigerating, and low tempering
UTS=284.5 (ksi), YS=229.4 (ksi); and CVN=28.1 (ft-lb)

After quenching, refrigerating, and low tempering plus middle tempering
UTS=309.7 (ksi), YS=252.8 (ksi), and CVN=18.3 (ft-lb)

The critical temperatures, and content of retained austenite of Steel A equal to:

$$Ac3=1445\cdot(1-0.091\cdot(C-0.40)+0.005\cdot(Cr-1.23)-0.011\cdot(Ni-2.48)+0.006\cdot Mo)\ (F) \quad (34)$$

$$Ac1=1238\cdot(1-0.012\cdot(C-0.40)+0.019\cdot(Cr-1.23)-0.012\cdot(Ni-2.48)+0.009\cdot Mo)\ (F) \quad (35)$$

$$Ms=437\cdot(1-1.519\cdot(C-0.40)-0.026\cdot(Cr-1.23)-0.087\cdot(Ni-2.48)-0.013\cdot Mo)\ (F) \quad (36)$$

$$CRA=11.5\cdot(1+5.527\cdot(C-0.40)-0.010\cdot(Cr-1.23)+0.357\cdot(Ni-2.48)-0.014\cdot Mo)(\%) \quad (37)$$

The critical temperatures and content of retained austenite with the optimum alloy concentration #1 equal to:
$A_{C3}$=1422, $A_{C1}$=1219, and $M_S$=354 (F); CRA=19.6(%).

Further, the properties of Steel A with the optimum alloying concentrations will be marked as properties #1.

FIG. 8.1 shows a Continuous Cooling Transformation (CCT) diagram of Steel A.

Based on the optimum alloy concentration #1, the results of modeling mechanical properties of Steel A are submitted in Example 1.

Detailed Descriptions of Preferred Embodiments Made with the New Method

Examples of articles made with the new method are divided into three low cost, high strength, high toughness martensitic steels, Steel A, Steel B, and Steel C.

Steel A is a new cobalt free steel with concentrations of Mo up to 1% wt. and Ni up to 3.5% wt. for highly stressed aircraft/aerospace and military components such as aircraft landing gears.

Steel B is a new cobalt-molybdenum free steel with concentration of Ni up to 1% wt. for general aircraft/aerospace and automotive, and oil/gas applications.

Steel C is the lowest cost steel. It is a cobalt-molybdenum-nickel free steel for automotive and oil/gas applications.

One important benefit of Steels A, B, and C is that they are capable of replacing a number of high strength industrial steels. The reduced complexity will increase production volumes, reduce investment costs, reduce the number of melts, and reduce the inventories of steel producers. The cost effective compositions were achieved by selecting the ratios between the austenite stabilizing, ferrite stabilizing, and carbide forming elements, selecting processing procedures, and heat treatment.

The processing procedures of the new steel include homogenized annealing, hot rolling or forging, recrystallization annealing, normalizing and high tempering. The heat treatment procedures of the new steel include quenching, refrigeration, and tempering.

The reductions in cost without reductions in mechanical properties were reached by eliminating the expensive Co, reducing the amounts of Ni and Mo, eliminating the high energy vacuum arc re-melting (VAR) and electroslag re-melting (ESR) processes, and replacing the vacuum induction furnace and vacuum arc furnace with the open induction furnace for melting the steel. An additional advantage of Steel C is the opportunity to utilize the continuous-casting process.

High strength martensitic steels are well represented in the art. FIGS. 1 through 4 reveal several important differences between the popular high strength steels of several American manufacturers and the present invention. First, the amounts of the alloying elements in the new steel are substantially less than the amounts in the manufacturers' steels.

The alloying elements in the AerMet 100 and Marage 250 by weight are 28.8% and 32% whereas; the alloying elements in Steel A are less than 11.5%. Another difference is the amount of expensive elements Ni, Mo, and Co. Steel A has up to 3.5% of Ni, up to 1% of Mo, and no Co, versus of 11.1% and 18.5% of Ni, 1.2% and 4.8% of Mo, 114% and 7.5% of Co in AerMet 100 and Marage 250, respectively.

Steel B has up to 1% wt. of Ni and no Mo, versus 1.65 to 2.0% wt. of Ni and 0.2 to 0.65% wt. of Mo in AISI 4340 and 300M steels.

Steel C is the cheapest new steel without Co, Mo, and Ni but possesses mechanical properties higher than AISI 8640 steels.

The FIGS. 3 and 4 also show that despite the substantial reduction in alloying elements, the strength and impact toughness of Steel A are about equal to AerMet 100 and higher than Marage 250, and that Steel B has a higher strength, impact and fracture toughness than AISI 4340 and 300M, and that Steel C has strength and impact toughness higher than AISI 8640 steel.

FIG. 5 compares the cost per metric ton of the charged materials of the new steels with the manufacturers' steels.

Aermet 100 ($18,020) and Marage 250 ($16,650) with Steel A ($2,800)

AISI 4340 ($1,470) and 300M ($1,760) with Steel B ($1,210)

AISI 8640 (at least $1,470) with Steel C ($980).

Costs of materials are based on cost data of the London Metal Exchange (LME), dated October, 2008.

The compositions of new steels consist of carbon (C); ferrite stabilizing chromium (Cr), aluminum (Al), silicon (Si); strong carbide forming vanadium (V), titanium (Ti), niobium (Nb); austenite stabilizing nickel (Ni), manganese (Mn), and copper (Cu); iron (Fe) and incidental impurities.

Carbon (C) contents of 0.30 to 0.45% wt. for the Steel A, B, and C support the forming of carbides of at least of an element selected from the group consisting of vanadium (V), titanium (Ti), niobium (Nb) or complex carbides as centers of growth of martensite laths forming the microstructure of tempered dispersed lath martensite with retained austenite, where contents of retained austenite are less than 25% for Steel A, less than 15% for Steel B, and less than 10% for Steel C.

The chromium (Cr) content at most 2.5% wt. in Steel A, B, and C. Chromium in the new steel increases strength, hardenability and temper resistance.

The molybdenum (Mo) content in Steel A is up to 1% wt., and it is eliminated from Steel B and C. Mo is used efficiently for improving hardenability, reducing reversible temper brittleness, resisting hydrogen attack and sulphide stress cracking, increasing elevated temperature strength.

The nickel (Ni), an austenite stabilizing element, supplies high toughness, however its concentration is limited in the martensitic structure. The content of Ni is at most 3.5% wt. in Steel A, at most 1.0% wt. in Steel B, and it is eliminated in Steel C.

Manganese (Mn) is a strong deoxidizing, and austenite stabilizing element. Its content is 0.3 to 1.0% wt. in Steels A and Steel B, and 0.3 to 3.5% wt. in Steel C.

Silicon (Si) strengthens the steel matrix by increasing the bonds between atoms in a solid solution. It protects the grain boundary from the growth of carbides, which decrease the toughness of the new steel. The concentration of Si is 0.1 to 1.3% wt. in Steel A, B, and C.

The copper (Cu) improves properties such as corrosion resistance, ductility, and machinability. The preferred amounts of Cu is 0.1 to 1.0% wt. in Steels A, B, and C. The concentration of Cu is less than the concentration of Si.

Vanadium (V) affects the structure and properties of the new steel in several ways. It forms finely dispersed particles of carbides in austenite, which control the size and shape of grains, by precipitating vanadium based, fine dispersed secondary carbides during tempering and by affecting the kinetic and morphology of the austenite-martensite transformation. Titanium (Ti) is a more active carbide forming element than vanadium (V). It acts in a similar way as vanadium (V) in the new steel. Small concentrations of the strong carbide forming niobium (Nb) do not affect the kinetics of phase transformations. A basic function of niobium carbides is to inhibit austenite grain growth at high temperatures during heating. At least one element selected from a group consisting of V, Ti, and Nb is a part of the new steel. The concentrations of (V+Ti+Nb) is 0.1 to 1.0% wt. in Steels A, B, and C.

Aluminum (Al), the most effective element for deoxidizing, is at most 0.25% wt. in Steels A, B, and C.

The balance of the new steel is iron (Fe) and incidental impurities.

Small amounts of phosphorus (P), sulfur (S) and other incidental elements will not critically affect the mechanical properties of the new steel.

Based on the optimum alloying concentrations, the critical temperatures, and the contents of retained austenite #2 and #3 lab scale ingots of the two new steels were melted and processed, and articles from the new steels were heat treated and tested. The lab scale ingots were produced in an 100 lb open air induction furnace and cast into cylindrical graphite molds. Liquid metal was poured at 2950 to 3000° F. After air cooling to the room temperature, 60 lb ingots were subjected to homogenized annealing at 2100 to 2150° F. for 6 hours. Thereafter, ingots were heated to 2100 to 2150° F. and rolled to a final size of approximately 1.5" thickness plates and 1" diameter rods. Further, plates and rods were subjected to re-crystallization annealing at 1100 to 1150° F. for 6 hours.

Standard ASTM specimens for tensile and Charpy V-notch impact toughness tests were machined. The machined specimens were subjected to the following heat treatment:

Austenizing at 1580 to 1650° F. for 60 min., oil quenching for 2 to 2.5 min., and then air cooling to the room temperature Some specimens were subjected to refrigerating at −120° F.

Tempering of the specimens at 340 to 450° F. for 3 to 3.5 hours

After heat treatment, the specimens were subjected to mechanical tests.

In order to better disclose the invention in detail, the following three examples are furnished. It should be understood, however, that these examples are presented merely as illustrations of the invention and that the ingredients specified therein may vary.

EXAMPLE 1

Steel A

Steel A has the optimum alloying concentration C=0.40, Cr=1.225, Ni=3.5, Mn=0.7, Cu=0.55, V=0.25, Si=0.9, Mo=0.5, and Ti=0.12

Figure 7:
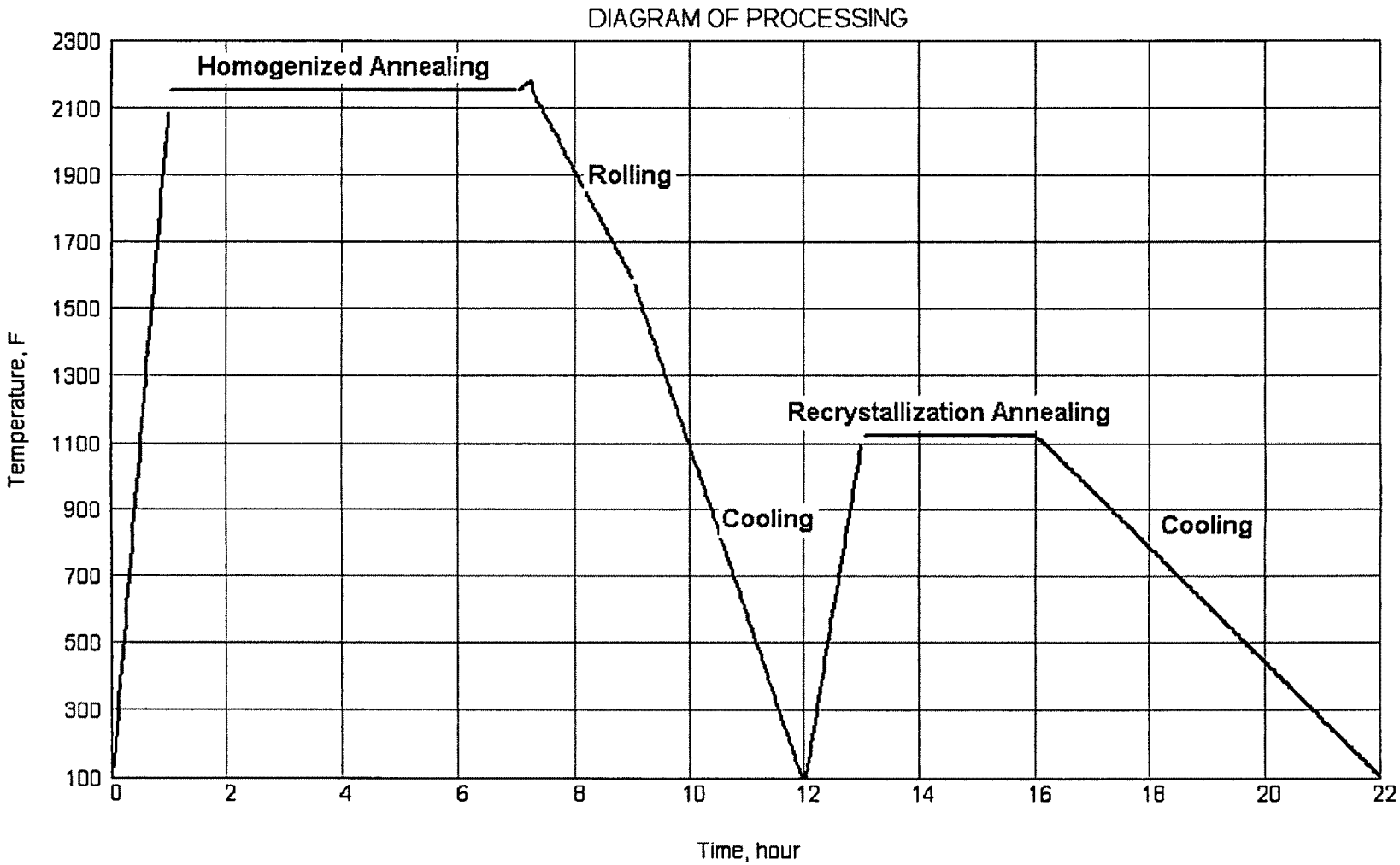
FIG. 7 shows a diagram of processing of the new steel that was defined by the results of the modeling.

Processing of Steel A is shown on the diagram of processing, FIG. 7. The critical temperatures are defined by modeling.

CCT diagram of Steel A is shown on FIG. 8.1.

According to the calculations, Steel A has the following mechanical properties

| | |
|---|---|
| Ultimate Tensile Strength (UTS), | |
| after austenizing at 1875-1925 F., oil quenching, refrigeration, and low tempering at 350-400 F. | 284.5 ksi |
| after refrigeration, austenizing at 1875-1925 F., oil quenching, low tempering at 350-400 F., and middle tempering at 750-950 F. (second hardening) | 309.7 ksi |
| Yield Strength (YS), | |
| after austenizing at 1875-1925 F., oil quenching, refrigeration, and low tempering at 350-400 F. | 229.4 ksi |
| after austenizing at 1875-1925 F., oil quenching, refrigeration, low tempering at 350-400 F., and middle tempering at 750-950 F. (second hardening) | 252.8 ksi |
| Charpy V-notch Impact Energy, | |
| after austenizing at 1875-1925 F., oil quenching, refrigeration and low tempering at 350-400 F. | 28.1 ft-lb |
| after austenizing at 1875-1925 F., oil quenching, refrigeration, low tempering at 350-400 F., and middle tempering at 750-950 F. (second hardening) | 18.3 ft-lb |

EXAMPLE 2

Steel B

Based on the optimum alloying concentration #3, the nickel-free new steel comprising by % weight: 0.37 of C; 0.52 of Mn; 0.76 of Si; 0.53 of Cu; 1.73 of Cr; 0.24 of V and the balance Fe and incidental impurities was melted.

Processing of the new steel was conducted according the diagram of processing, FIG. 7, that that was defined by the results of the modeling.

Heat treatment of the new steel was conducted according to the CCT diagram, FIG. 8.2, that was defined by the results of the modeling:

Austenizing at 1625° F. for 60 min., oil quenching for 2 min., and then air cooling to the room temperature Refrigerating Tempering at 350° F. for 3 hours.

Tests of the specimens produced the following room temperature results.

| | |
|---|---|
| Rockwell Hardness | C 52 |
| Ultimate Tensile Strength (UTS) | 277 ksi |
| Yield Strength (YS): | 226 ksi |

-continued

| | |
|---|---|
| Elongation | 13.5% |
| Reduction of Area | 52.1% |
| Charpy V-notch Impact Energy | 32.2 ft-lb |

The microstructure of the test specimens is shown in FIG. 6.

EXAMPLE 3

Steel C

Based on the optimum alloying concentration #3, the nickel-free new steel comprised by % weight: The new steel by % weight: comprised 0.37 of C; 0.52 of Mn; 0.76 of Si; 0.53 of Cu; 1.73 of Cr; 0.24 of V and the balance Fe and incidental impurities.

Processing of the new steel was conducted according the diagram of processing, FIG. 7, that that was defined by the results of the modeling.

Heat treatment of the new steel was conducted according to the CCT diagram, FIG. 8.3, that was defined by the results of the modeling:

Austenizing at 1625° F. for 60 min., oil quenching for 2 min., and then air cooling to the room temperature Tempering at 350° F. for 3 hours.

Tests of the specimens produced the following room temperature results.

| | |
|---|---|
| Rockwell Hardness | C 53 |
| Ultimate Tensile Strength (UTS) | 281 ksi |
| Yield Strength (YS): | 216 ksi |
| Elongation | 12% |
| Reduction of Area | 43% |
| Charpy V-notch Impact Energy | 27.8 ft-lb |

The Steel B and C had microstructures comprised of small packets of martensite laths grown on fine carbides and retained austenite, boundaries of the packets are free of carbides and different contents of retained austenite (CRA):

Steel B had CRA of 11 to 15%

Steel C had CRA of 8 to 10%

From the above, it is apparent that the high strength, high toughness martensitic alloy steel which is the subject of our invention is an important development in the steel making art. Although only several embodiments have been described, it is obvious that other embodiments can be derived from what is claimed in the presented description without departing from the spirit thereof.

What we claim is new is:

1. A method of making a low cost, high strength, high toughness martensitic steel comprising the steps of applying a mathematical model to define an optimum low cost chemical composition of said steel having specified levels of strength and toughness; predicting the content of retained austenite and critical temperatures with said mathematical model; melting said optimum chemical composition; processing ingots of said optimum chemical composition; producing articles from said ingots; heat treating said articles using said critical temperatures and said content of retained austenite; and verifying the properties of said articles by mechanical testing, said steel comprising by weight of about: C: 0.3 to 0.45%; Cr: at most 2.5%: Mo: at most 1.0; Ni: at most 3.5%; Mn: 0.3 to 1.5%; Si: 0.1 to 1.3%; Cu: about 0.1 to 1.0%, where Cu is less than Si; (V+Ti+Nb): about 0.1 to L0%; Al: at most 0.25%; a sum of alloying elements being less than about 11.5%; the balance being essentially Fe and incidental impurities, said processing ingots comprising homogeneous annealing at about 2100 to 2150° F., hot rolling/forging with start temperature at about 2150 to 2170° F. and finish temperature at about 1800 to 1850° F., air cooling, subjecting to recrystallization annealing at about 1100 to 1150° F., and air cooling.

2. A method of making a low cost, high strength, high toughness martensitic steel comprising the steps of applying a mathematical model to define an optimum low cost chemical composition of said steel having specified levels of strength and toughness; predicting the content of retained austenite and critical temperatures with said mathematical model; melting said optimum chemical composition; processing ingots of said optimum chemical composition; producing articles from said ingots; heat treating said articles using said critical temperatures and said content of retained austenite; and verifying the properties of said articles by mechanical testing, said steel comprising by weight of about: C: 0.3 to 0.45%; Cr: at most 2.5%; Mo: at most 1.0; Ni: at most 3.5%; Mn: 0.3 to 1.5%; Si: 0.1 to 1.3%; Cu: about 0.1 to 1.0%, where Cu is less than Si; (V+Ti+Nb): about 0.1 to 1.0%; Al: at most 0.25%; a sum of alloying elements being less than about 11.5%; the balance being essentially Fe and incidental impurities, said heat treating comprising subjecting said articles to austenization at about 1885 to 1925° F., oil quenching, refrigerating, and low tempering at about 350 to 400° F.

3. A method of making a low cost, high strength, high toughness martensitic steel comprising the steps of applying a mathematical model to define an optimum low cost chemical composition of said steel having specified levels of strength and toughness; predicting the content of retained austenite and critical temperatures with said mathematical model; melting said optimum chemical composition; processing ingots of said optimum chemical composition; producing articles from said ingots; heat treating said articles using said critical temperatures and said content of retained austenite; and verifying the properties of said articles by mechanical testing, said steel comprising by weight of about: C: 0.3 to 0.45%; Cr: at most 2.5%; Mo: at most 1.0; Ni: at most 3.5%; Mn: 0.3 to 1.5%; Si: 0.1 to 1.3%; Cu: about 0.1 to 1.0%, where Cu is less than Si; (V+Ti+Nb): about 0.1 to 1.0%; Al: at most 0.25%; a sum of alloying elements being less than about 11.5%; the balance being essentially Fe and incidental impurities, said heat treating comprising subjecting said articles to austenization at about 1885 to 1925° F., oil quenching, refrigerating at about −40 to −60° F., and middle tempering at about 750 to 950° F. for about 5 to 6 hours.

* * * * *